US012594481B2

(12) United States Patent
Zimmerman

(10) Patent No.: US 12,594,481 B2
(45) Date of Patent: Apr. 7, 2026

(54) INTERACTIVE AGILITY POST, AND SYSTEM, MEDIA AND METHODS FOR AN INTERACTIVE AGILITY POST

(71) Applicant: Adam Zimmerman, Hurricane, WV (US)

(72) Inventor: Adam Zimmerman, Hurricane, WV (US)

( * ) Notice: Subject to any disclaimer, the term of this patent is extended or adjusted under 35 U.S.C. 154(b) by 121 days.

(21) Appl. No.: 18/413,348

(22) Filed: Jan. 16, 2024

(65) Prior Publication Data

US 2025/0229157 A1 Jul. 17, 2025

(51) Int. Cl.
*A63B 71/06* (2006.01)
*A63B 69/00* (2006.01)

(52) U.S. Cl.
CPC ..... *A63B 71/0622* (2013.01); *A63B 69/0071* (2013.01); *A63B 2071/0636* (2013.01); *A63B 2214/00* (2020.08); *A63B 2220/13* (2013.01); *A63B 2220/30* (2013.01); *A63B 2220/40* (2013.01); *A63B 2220/62* (2013.01); *A63B 2220/807* (2013.01); *A63B 2220/833* (2013.01); *A63B 2225/54* (2013.01); *A63B 2225/74* (2020.08)

(58) Field of Classification Search
CPC ..... A63B 71/06; A63B 71/0622; A63B 67/00; A63B 63/00; A63B 2022/0092; A63B 2220/833; A63B 2220/40; A63B 2220/30; A63B 2220/807; A63B 2220/62; A63B 2220/13; A63B 2225/74; A63B 2225/54; A63B 2071/0636; A63B 2214/00
See application file for complete search history.

(56) References Cited

U.S. PATENT DOCUMENTS

| | | | | |
|---|---|---|---|---|
| 9,757,637 | B1 * | 9/2017 | Glaser | A63B 69/0071 |
| 10,610,143 | B2 * | 4/2020 | Tinjust | G09B 19/0038 |
| 12,465,838 | B1 * | 11/2025 | Ebrahimi Afrouzi | A63B 69/38 |
| 2023/0285806 | A1 * | 9/2023 | Webster | G06T 7/20 |

* cited by examiner

*Primary Examiner* — Megan Anderson
*Assistant Examiner* — Jonathan A Dicuia
(74) *Attorney, Agent, or Firm* — Jaensson Law PLLC; Monika L'orsa Jaensson, Esq.

(57) ABSTRACT

Systems, media and methods for an interactive agility post are provided. A system includes an agility post having a stanchion on a stability base, with arms rotatably affixed to the stanchion, and lights, sensors and cameras positioned about the stanchion. The system may further include a receiving module configured to receive positional data relative to the agility post. Further provided is a non-transitory computer readable medium embodying computer-executable instructions that when executed by a processor cause the processor to receive sensor data from a communications module of the agility post, reflecting user positional data relative to an agility post, and camera video from a plurality of cameras positioned on the post. Also provided is a method including receiving from a plurality of sensors positional data of a user relative to an agility post, and receiving from a plurality of cameras video data of the user relative to the agility post.

13 Claims, 9 Drawing Sheets

INTERACTIVE AGILITY POST, AND SYSTEM, MEDIA AND METHODS FOR AN INTERACTIVE AGILITY POST

The disclosed technology provides an interactive agility post system useful in training athletes to lower their center of gravity, while keeping their eyes up and increasing their speed and agility in basketball. The disclosed technology further provides a system, media and methods for tracking and improving athlete agility, speed and body position.

General Description

In one embodiment, an interactive system useful in training athletes may include an agility post having a stanchion supported on a stability base, with two arms extending from and rotatably affixed to the stanchion. A light is positioned at the top of the stanchion, and one or more lights are positioned on or along each arm of the stanchion. Supported on the agility post are a plurality of sensors and cameras.

A communications module is secured to the agility post and configured to receive positional data from the sensors, to direct operation of the top light and the lights positioned on or along each arm pursuant to a light sequence, and to transmit the sensor data to a computing device. The computing device receives video data from the cameras and sensor positional data from the communications module, and calculates a user's travel path, body position, speed and acceleration, and displays the same on a user interface. One or more additional lights or lasers may be positioned on the post to direct the user's movement relative to the post pursuant to the light sequence.

The user interface of the computing device may receive user input to create the light sequence, which may be transmitted to the communications module. Further, the system may include a plurality of agility posts, each agility post having its own communications module; in this embodiment the communications module of the agility posts may communicate with each other.

In this and other embodiments, a non-transitory computer readable medium embodies computer-executable instructions that when executed by a processor cause the processor to receive sensor data from the communications module reflecting user positional data relative to an agility post, and camera video from a plurality of cameras positioned on the post. The processor may also create and display a record associated with the user based upon the sensor positional data. The processor may further output to the communications module light sequence data, which the communications module will use to activate lights on the agility post.

In these and other embodiments, a method may include receiving from a plurality of sensors positional data of a user relative to an agility post, and receiving from a plurality of cameras video data of the user relative to the agility post. The method may further include creating and displaying a record associated with the user based upon the sensor positional data and the camera data, and outputting to a plurality of lights on the agility post light sequence data configured to activate a light sequence in the plurality of lights. The method may also include creating the light sequence data.

These and additional features provided by the embodiments described herein will be more fully understood in view of the following detailed description, in conjunction with the drawings.

DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals, and in which:

DETAILED DESCRIPTION

Embodiments of the present disclosure are directed to methods, systems, and media for an interactive agility post that utilizes sensor data and camera video and interacts with a graphical user interface. For a given drill (using one or more agility posts of the disclosed technology) various sensors and cameras may be available to capture movement data through the drill, including body position. For example, using sensor data, speed, acceleration and position relative to the post may be accurately identified. Similarly, using camera data, body position in the drill can be identified. Additionally, a graphical user interface may be utilized to design, modify and/or review a user's path to and past one or more agility posts. Utilizing sensors, camera data, and a graphical user interface with the herein presented agility post can provide a dynamic drill to athletes, and a highly accurate, reliable, quickly available and readily accessible analysis of one or more user drills through the system.

Figure 1:
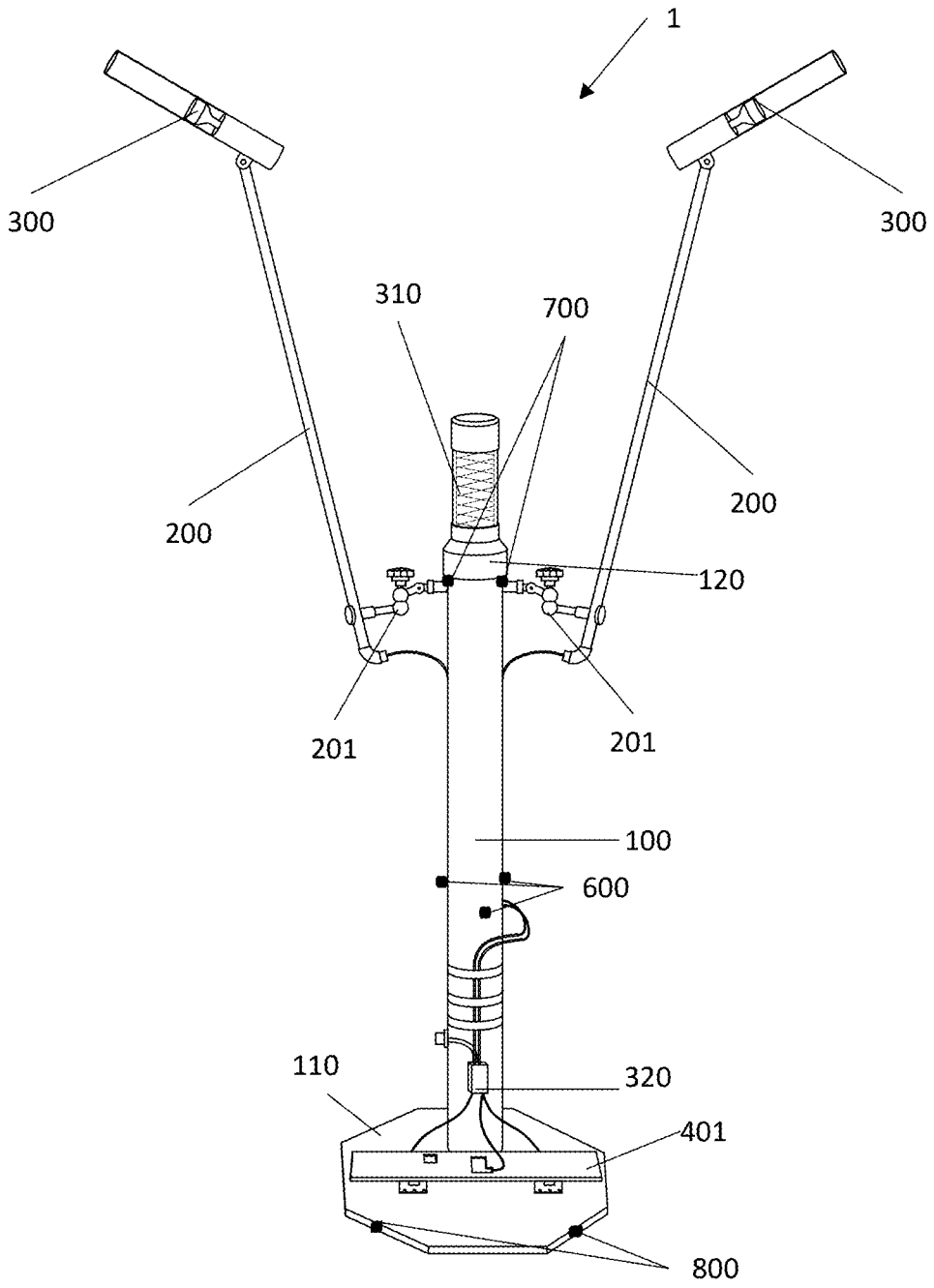
FIG. 1 depicts an embodiment of an agility post of the disclosed technology.

Referring now to FIG. 1, an embodiment of an agility post 1 of the disclosed technology is shown. The agility post includes a stanchion 100 with a stability base 110, and at least two arms 200 extending from and rotatably affixed to the sides of the stanchion. A top light 310 (typically red) is positioned at the top of the stanchion which when lit signals the athlete to stop, and a second light 320 (typically yellow) may be positioned on the front of the stanchion which when lit signals the athlete to retreat. Further, one or more lights 300 are positioned on or along each arm signaling the direction the athlete should pass the post, under the respective arm. Lasers 800 may be positioned along the base of the stanchion to signal the athlete to pivot or jab step.

Positioned about the stanchion and/or the stability base are a plurality of sensors 600 to sense the athlete's presence about the post, and one or more cameras 700 to record and transmit images or video of the athlete to a computing device, as hereinafter described.

The operation and in some embodiments the color or pulsation of the lights and lasers is controlled by a communications module 400. The communications module 400 further communicates with, and/or receives data from, the sensors, and transmits some or all of such data to a computing device. Further, the communications module 400 receives light sequence data from the computing device. Using sensor data and/or data from the device, the communications module directs the lights and lasers of the agility post 1, and controls the operation of the sensors and cameras. Video or pictures captured by the cameras are communicated directly to the computing device for further processing. Using sensor and camera data received by the device, the computing device calculates the athlete's speed and acceleration, as well as determining and assessing the presence and body position of an athlete.

Returning to FIG. 1, the stanchion 100 is presented as a cylinder with a stability base 110, or as a cone with a stability base. The stanchion may be made of any suitable, durable material to maintain the structure of the stanchion and support the related elements of the disclosed technology. A collar 120 may be positioned on the stanchion to support the cameras 700. The communications module may be positioned in a housing 401 on the stability base 110 as shown, or alternatively may be positioned within the stability base 110 or elsewhere on or within the agility post 1.

Rotatably affixed to the stanchion are at least two arms 200. The rotation of the arms relative to the stanchion may be provided in two or more planes. Useful in providing full rotational coupling of the arms to the stanchion are adjustable, articulating friction magic arms 201 such as model MA-7 offered by Vidpro, wherein one end of a magic arm is affixed to the stanchion, and the other end to the arm of the agility post 1. The arms 200 may be made of any suitable material to maintain the structure of the arm. Each of the arms 200 may present as a single element, or may present in segments, wherein the segments may themselves be rotationally coupled together to allow rotation in one or more planes. In either of these configurations, the arms may be positioned relative to the stanchion so that the athlete must lower his or her body position to pass the agility post, under the arm, as directed by the light signals; thereby, the positioning of the arms may be adjusted based upon the height and ability of the athlete.

One or more lights may be presented on the stanchion to direct the athlete's movement relative to the agility post, the operation of which is controlled by the communications module. In the embodiment shown, a light 310 on top of the stanchion may present in red, for example, indicating that the athlete should stop. Further, a second light 320 on the front of the stanchion may present in yellow, for example, indicating that the athlete should retreat. Lasers 800 may be positioned along the base of the stanchion to signal the athlete to pivot or jab step.

Presented on each of the arms 200 are one or more lights 300, the operation of which is also controlled by the communications module 400, to direct the travel of the athlete past the agility post 1. The light(s) 300 may be secured to one or more sides of the arms 200, along any portion thereof, or present at the end segments of the arms, as shown.

These and other lights and lasers may direct the athlete's movement relative to the agility post, and may present in a single color or may present in two or more colors as directed by the communications module 400. The lights may be positioned along the exterior of the post 1, secured within the post 1 and extending through apertures, or secured within the post wherein at least a portion of the post is translucent to allow light from the LEDs to be visible to an athlete.

The lights 300, 310 and/or 320, and lasers 800, may be light emitting diodes (LED), or other suitable lighting, such as incandescent, halogen, compact-fluorescent, fluorescent, solar, laser, flame, and the like. In some embodiments, to signal direction the lights present in one color (e.g., green) on one or more arms, and another color (e.g., red) on one or more other arms. In other embodiments the lights signal direction by presenting on one or more arms colored or clear, while the lights on the other arm(s) are off. In these and other embodiments, any of the lights and lasers may pulsate, at one or more rates, particularly useful to direct color-blind athletes to stop, retreat, and/or travel in a particular direction.

In embodiments the lights and lasers may be powered and controlled by wiring from the communications module 400, through or about the stanchion and along the exterior of the arms 200, or within a hollow interior of the arms, if any. In other embodiments, wireless power and/or communication mechanisms may be utilized, such as wireless communications (RFID, NFC, etc.) and battery-operated LEDs.

Sensors 600 are secured about the stanchion 100, preferably on three or more sides. The sensors 600 are coupled with the communications module 400 to provide data which can be used by the communications module and/or the computing device (as hereinafter described) to calculate and/or display the direction, path, speed, acceleration and reaction time of the athlete as he or she approaches and passes the agility post. Data from the sensors may include the athlete's presence, distance and position relative to the post 1.

Further, as a sensor detects the presence of an athlete, it may activate (via the communications module and/or the computing device) random or pre-programmed light signals on the stanchion and the arms. Alternatively, the sensor's detection of the presence of an athlete may activate a single light signal, and then either alone or with data from other sensors and/or the camera determine whether the athlete has taken the appropriate action corresponding to the light signal before proceeding on to a second light signal, and so on. Data communicated by the sensor to the communications module and/or the computing device is herein referred to as "positional data."

Any suitable type of sensor may be utilized to detect and track the position of the athlete, including wired or wireless technology (e.g., BLUETOOTH, Bluetooth Low Energy, NFC, Wi-Fi, radio wave, etc.). An example of a sensor suitable for use in the disclosed technology is the Adafruit Vl530X, a distance sensor utilizing laser sources.

In embodiments, the sensor may detect the athlete no further than a certain pre-determined distance from the sensor (e.g., 3 feet), wherein the pre-determined sensing distance may be set through the computing device and communicated to the sensor(s) via the communications module 400. In this embodiment the presence of the athlete within the pre-determined distance is communicated to the communications module to trigger the light sequence. Alternatively, the sensor may communicate the distance and position an athlete travels over time in the sensing area, wherein the distance and position is communicated to the communications module, which triggers the light sequence when the communications module (or the computing device receiving such data from the communications module) determines from the positional data that the athlete has reached a certain pre-determined distance from the sensor. The light sequence may then proceed with additional light signaling as set through the communications module, or in a random sequence, in either case with or without additional positional data triggering other segments of the signaling sequence.

One or more cameras 700 may be affixed to and supported by the stanchion 100 to take still pictures or videos of an athlete as they travel about the agility post 1; these pictures may be transmitted by the camera to the communications module (and then further communicated to the computing device), directly to the computing device, or to a storage location in a remote location. The cameras 700 may be supported on the underside of a collar 120 secured about the stanchion, or otherwise secured to the stanchion. In some embodiments four cameras are presented, one on each side of the stanchion. Suitable cameras for use in the disclosed technology are provided in the OPENCV AI KIT: OAK-D by Luxonis Holding Corporation. Operation of the cameras (e.g., video capture on/off) may be controlled by the communications module, based upon a start or stop signal, a time lapse after the front sensor senses the athlete, or otherwise (or any combination thereof).

Through the video feed from the camera received directly or indirectly by the computing device, the athlete's position and movement relative to the agility post of the disclosed technology may be tracked. Further, the video feed may be used by the computing device to determine and visually present the athlete's body position (high/low, body angle, level of attack, center of gravity) for teaching purposes. In addition, the computing device may determine and visually present the athlete's shin and hip angles from the video feed, to help an athlete achieve better positioning and prevent future injuries. These and other body position calculations and presentations may be determined and presented using programs such as Computer Vision available through Open CV, and motion capture software available from various vendors. A picture of the athlete may be captured prior to commencing use of the agility post of the disclosed technology, to measure the athlete's unique body size, height, limbs and torso elements, to help inform the application as it generates visual presentations and assessments of the athlete's body position using the agility post. By analyzing camera data of a user's position, movement in each direction and position of the athlete's body, in three-dimensions (x, y, z) may be analyzed.

In embodiments of the disclosed technology, multiple agility posts are used in a single drill. In these embodiments, the communications module 400 of each post 1 communicates either directly (wirelessly) or indirectly (through the computing device) with communications modules of the other posts. Thus, for example, as an athlete is detected as passing a first post (determined by the communications module or the computing device from sensor and/or camera data), a 'start' signal may be communicated to a second post to commence its sensing, light signaling, and video capture. In this configuration the application may capture data as the athlete travels through the sequence of posts. Other drill technology may likewise be in communication with one or more posts to create a robust drill, such as the agility ladder as described in U.S. Pat. No. 10,912,976, issued to the present applicant on Feb. 9, 2021.

The communications module 400 may be any suitable type of electronics to facilitate communications and/or power to and/or from the agility post 1. For example, the communications module 400 may utilize any suitable wireless and/or wired technology to receive from the communications module light sequence data, including for example 'stop,' 'start,' 'reverse,' 'jab step', and 'right/left' directional instructions. The light sequence data may be received in a packet, comprising all data, or may receive segments or independent data instructions over time. In either configuration, as an example, the communications module will activate light 310 upon a stop directional instruction, deactivate light 310 upon a start directional instruction, activate light 320 upon a reverse directional instruction, activate one or more lasers 800 for a jab step instruction, and activate the lights 300 on one of the arms 200 corresponding to the right or left directional passing instruction. Activation may include directing the coloration of the lights, wherein for example upon a right directional instruction the lights 300 on the right arm are activated as green, and the lights 300 on the left arm are activated as red. The light sequence data communicated to the communications module may include time data, indicating the duration of each signal in the sequence. In embodiments, the light sequence may further be directed by sensor data, received by the communications module, as directed by the computing device and its sensor triggering data; for example, the sensor triggering data may direct the sequence to pause at the stop signal until sensor data indicative of an athlete stopping a pre-defined distance from the post is received, and then the sequence may proceed on to the reverse signal. This pause awaiting sensor data, as directed by sensor triggering data, may occur at any point in the light sequence.

The communications module 400 may also receive power from external sources (electric outlet, battery, solar cell/panel, wireless power transmittal, etc.). The communications module 400 may transmit, via the wiring 801, the light sequence data (in the form of individualized lighting instructions which may be analog or digital) to each LED 300, 310, 320 and/or laser 800; alternatively, the communications module may simply supply power to the respective light/laser in accordance with the light sequence data. The LEDs and lasers may be connected to the communications module 400 with positive and negative wires, along with a separate ground. The communications module 400 may further have a receiving module to receive positional data of an athlete relative to the agility post from one or more of the sensors and/or the cameras, wherein the positional data may comprise location and/or body position relative to the post. The communications module may further have an output module configured to output such positional data for purposes of calculating user reaction, speed, acceleration, body position and other data as hereinafter described, and communicating the same to the computing device and its interface 120. Alternatively or additionally, the sensors and/or the cameras may communicate all or some of the positional data to the computing device, independent of the communications module.

Figure 2:
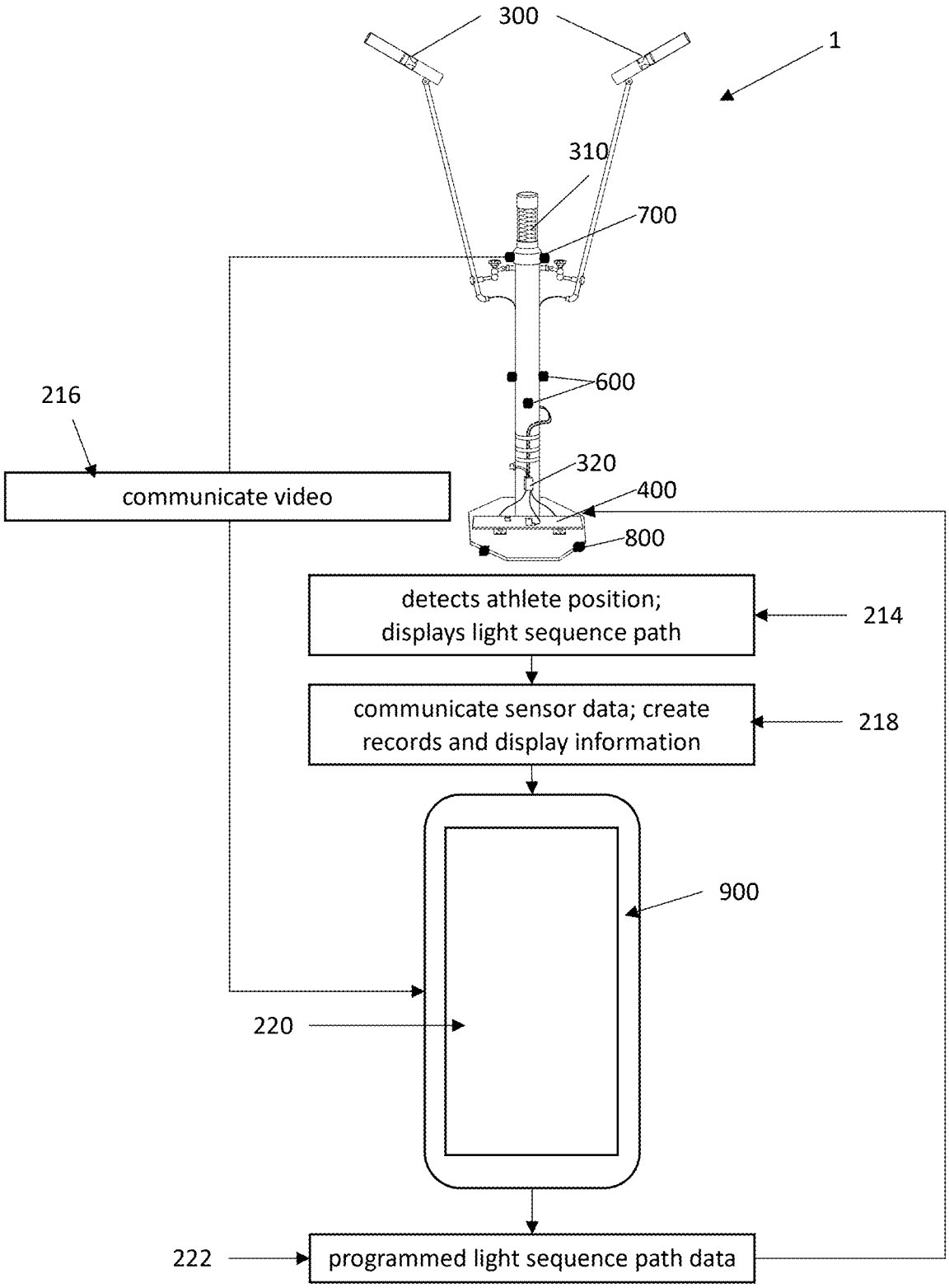
FIG. 2 is a flow diagram depicting exemplary interaction of sensors, an agility post, and a computing device, according to one or more embodiments shown and described herein.
Figure 5:
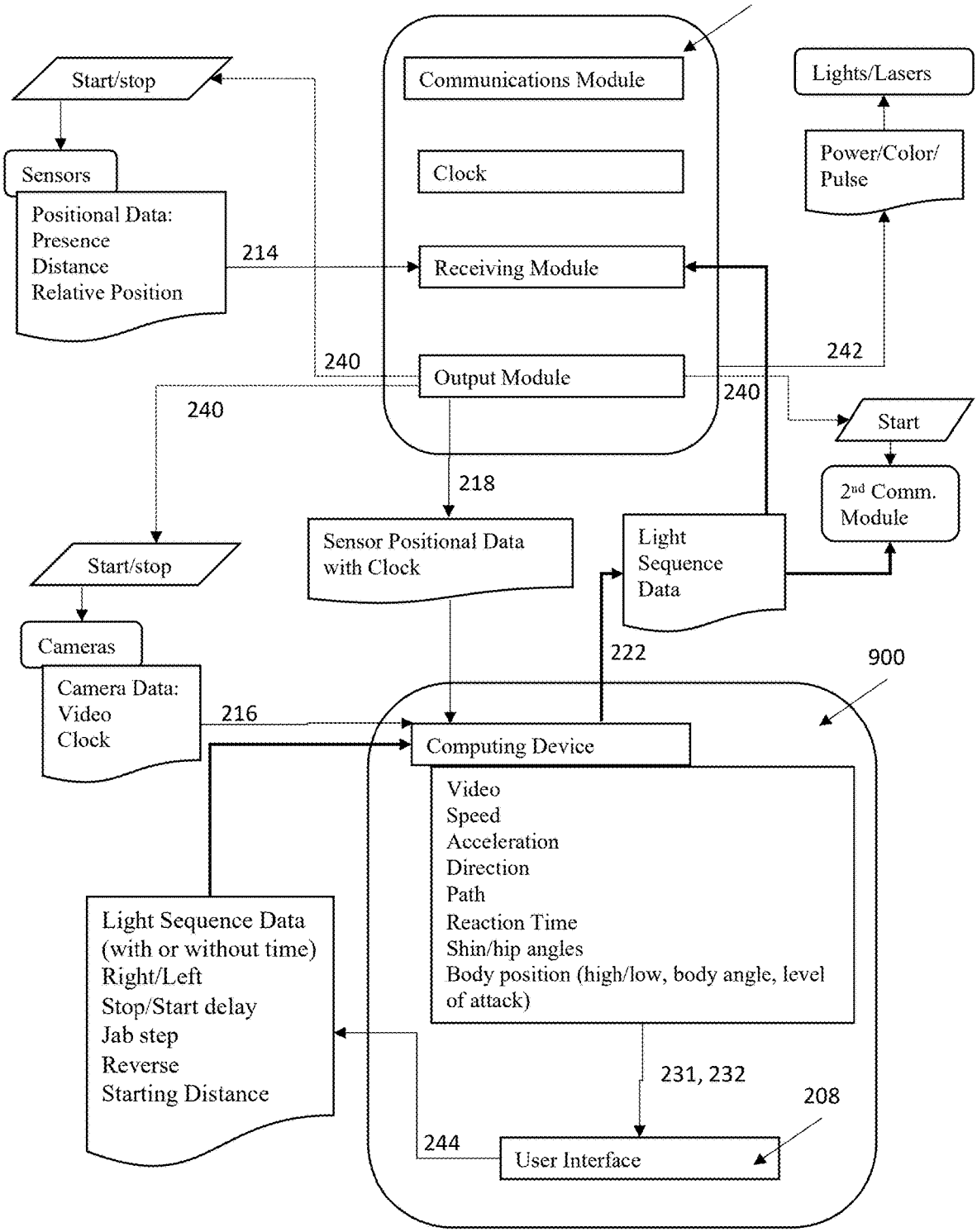
FIG. 5 depicts an embodiment of data flow among the sensors, cameras, a pair of communications modules, a computing device and lights/lasers of the disclosed technology, according to one or more embodiments shown and described herein.

Referring now to FIG. 2, a flow diagram depicting exemplary interaction of an agility post 1, and a computing device 900 is shown according to various embodiments. See, also, FIG. 5, a representation of an embodiment of data flow between the post 1 and the computing device 900. Sensors 600 and cameras 700 are positioned about the agility post in this embodiment. At block/line 214, an athlete's positional data is determined by the sensors and communicated to the receiving module within the communication module 400. In this embodiment, this is done in real-time. A communication module may be, for example, a microcontroller (IMU by X-IO Technologies) or programmable logic controller (JAZZ® & M91™ by UNITRONICS). The communication module 400 may feature a rechargeable battery to provide power to components such as the LEDs 300, 310 and 320, and lasers 800. Other embodiments may provide for transmission of such information at specified intervals or upon certain events, such as the user having passed the agility post or upon completion of a sequence of agility posts. At block/line 216, video or picture data may be transmitted from the cameras 700 to the computing device 900. At block/line 218, records containing data from the communications module may be transmitted from the output module of the communication module 400 to the computing device 900. In this embodiment, the transmissions of video and data are wireless, but in other embodiments the agility post may utilize a wired connection to download this data to a device. Block 220 features a depiction of a computing device 900 presenting an interface. Details of the interface are discussed in more detail below. At block/line 222 programmed light sequence data is sent from the computing device to the communications module in order to have the agility post(s) display a new light sequence through signals 242. This light sequence data, as herein described, is generated at the interface, and processed at the computing device (line 244).

Further, the output module of the communications module may send start/stop signals 240 to the sensors, camera, and the communications module of a second post in the drill, thereby powering on each of these elements to capture the drill about the post, and powering down each of these elements when the drill or drill segment is complete. The elements may be powered on at one time, or in sequence.

Figure 3A:
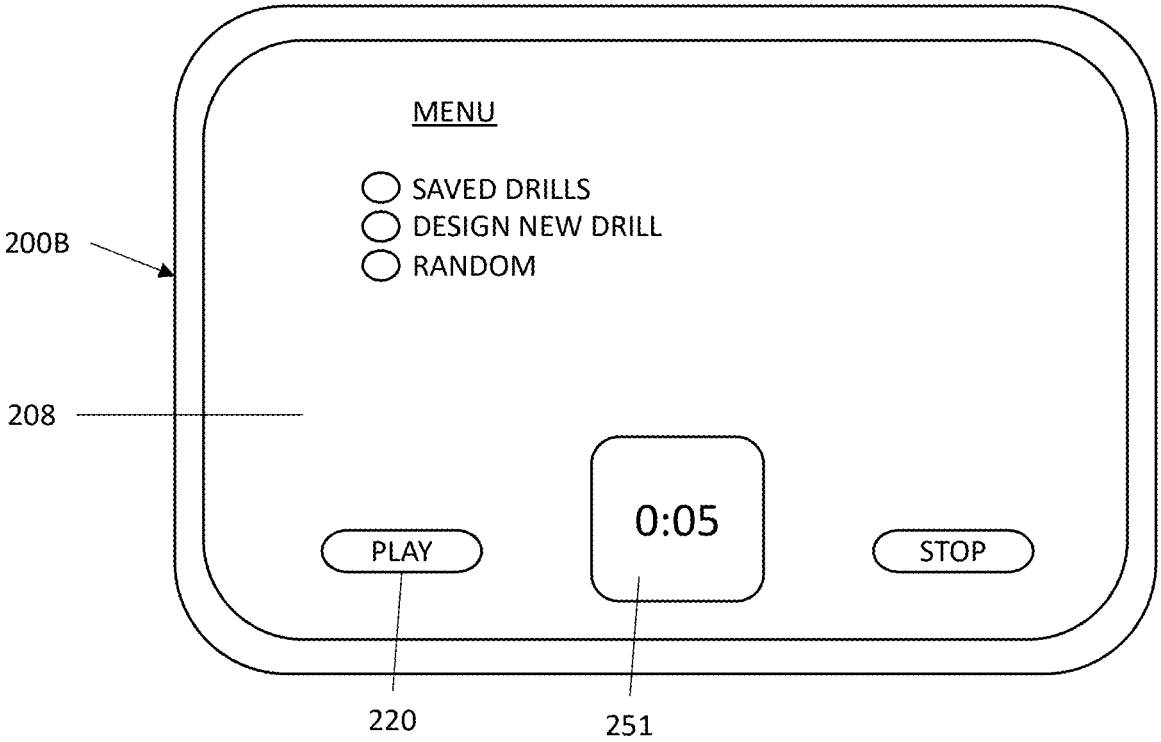
FIGS. 3A, 3B, 3C and 3D schematically illustrate a graphical user interface for programming a light sequence drill, according to one or more embodiments shown and described herein.
Figure 3B:
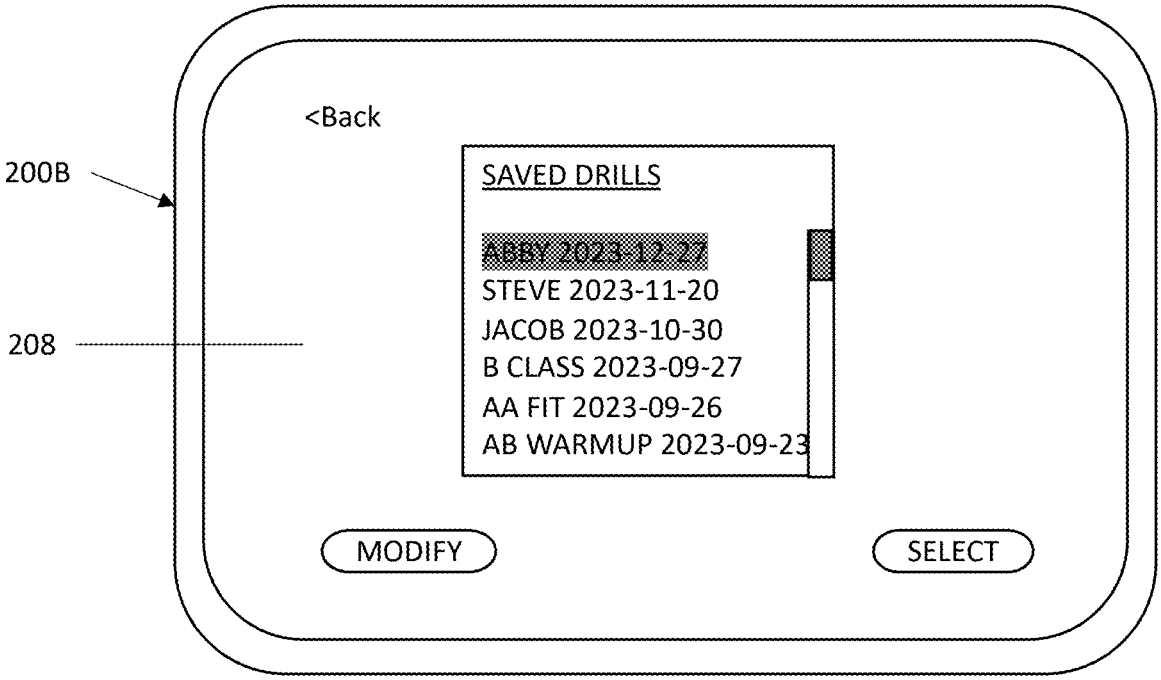
Figure 3C:
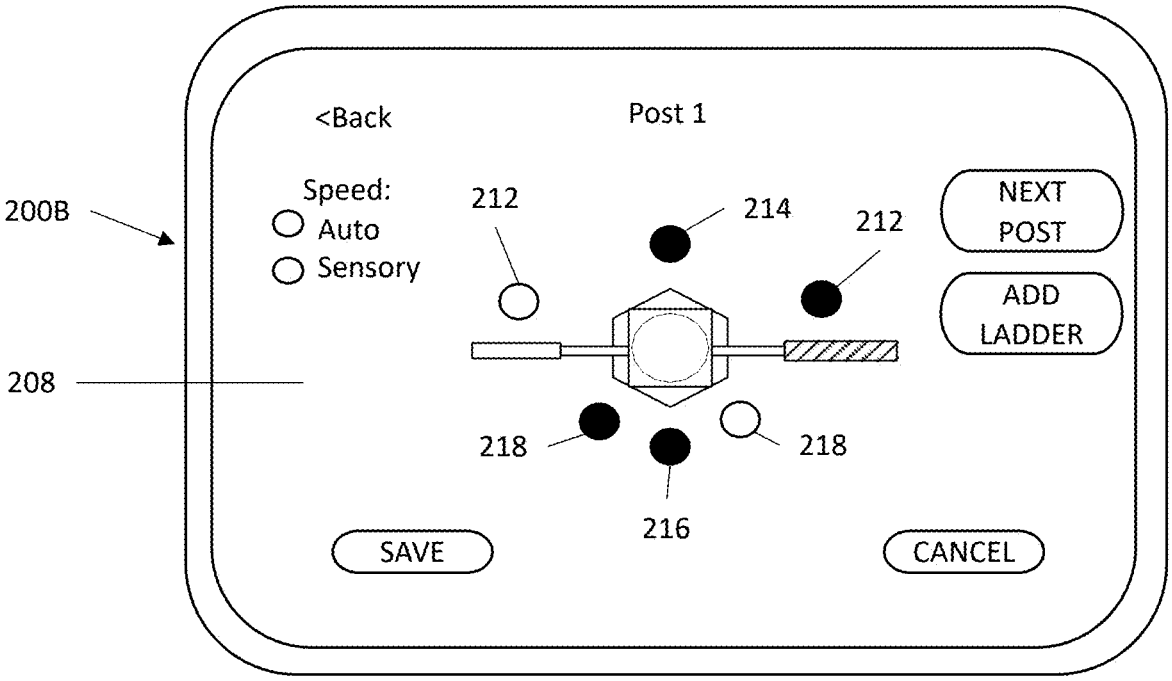
Figure 3D:
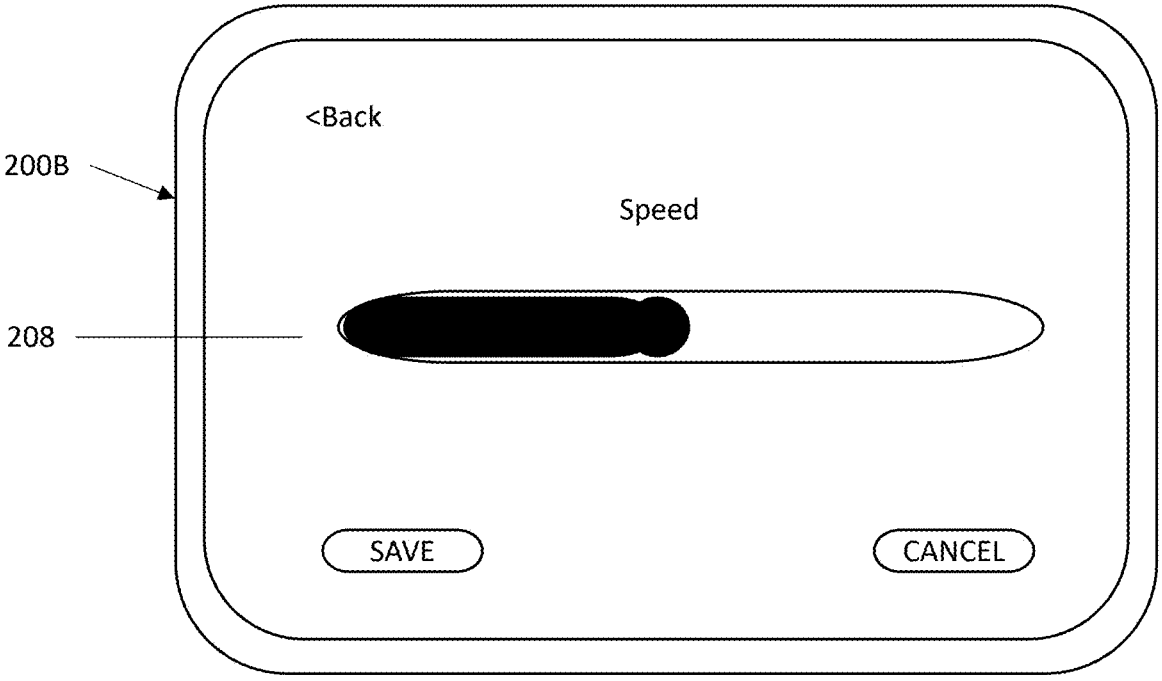

Turning now to FIGS. 3A, 3B, 3C, 3D and 5, an exemplary operating environment 200B depicts a graphical user interface 208 through which embodiments of the disclosed technology can be implemented. In this embodiment, the computing device outputs at 232 the interface 208 on a display. The device 206 may be any device capable of outputting a graphical user interface 208, such as a smartphone, tablet, laptop, desktop, server, and the like. Within the interface 208, the user is presented with multiple screens, including a menu screen (see FIG. 3A), wherein the user can select either saved drills (via the screen shown in FIG. 3B) and modify them (via the screen shown in FIG. 3C); the user can select a random light sequence; or the user may design a new drill (via the screen shown in FIG. 3C). As shown in FIG. 3C, a representation of agility post 1 in the interface 208 also provides indicators 212, 214, 216, 218 for one or more agility posts to allow the user to program the segments of the light sequence path in advance of the drill, within the viewpoint of the interface 208. Directional indicators 212 in this embodiment correspond to LEDs 300, indicator 214 corresponds with light 310, indicator 216 corresponds to light 320, and directional indicators 218 correspond with lasers 800 on the agility post. In this embodiment, the user of the agility post and/or someone else may design a custom light sequence path among one or more agility posts, and/or an agility ladder, and/or modify an existing one. In this way, a user can create and/or modify a post-by-post light sequence for the drill. Time sequence data (the timing of the segments of the sequence) may also be entered via this interface (see, e.g., FIG. 3D), as well as sensor triggering data if desired. Once the first post of the drill is programmed, the user may move on to programming subsequent posts or ladders, and save (or cancel) the drill.

For example, as shown in FIG. 3C, starting with a first post the segments of the light path sequence may be set, including stop indicator 214, reverse indicator 216, jab step indicator 218 to the left, and past directional indicator 212 to the right arm, the directional sequence then directs the user to stop, reverse, jab step to the left, and proceed to the right of the first agility post, and so on until the user completes the intended path among the agility posts. Some or all of these indicators may be timed through the interface, so for example the stop indicator may hold the athlete for 0.5 seconds, then the athlete may reverse for 0.3 seconds, then jab step and finally pass. A play button 220 may allow a user (which may be either the user of the agility post or another user) to initiate the directional sequence, which may correspond with the corresponding light sequence. Alternatively, the front sensor may sense the athlete a distance from the agility post and communicating with the communications module (which may further communicate with the device), cause the light sequence to commence, other sensors to turn on, and one or more cameras to record video, all with or without time delays or further sensor data. Data from other sensors may also be used to start, stop or interrupt the sequence of lights. In some embodiments the communications module has pre-programmed signals (i.e., upon a sensor communicating to the communications module the location of the athlete within 3' of the stanchion, the previously communicated light direction sequence commences); in other embodiments, the communications module transmits all sensor data to the computing device, and the device directs the communications module to take a next action.

Figure 4C:
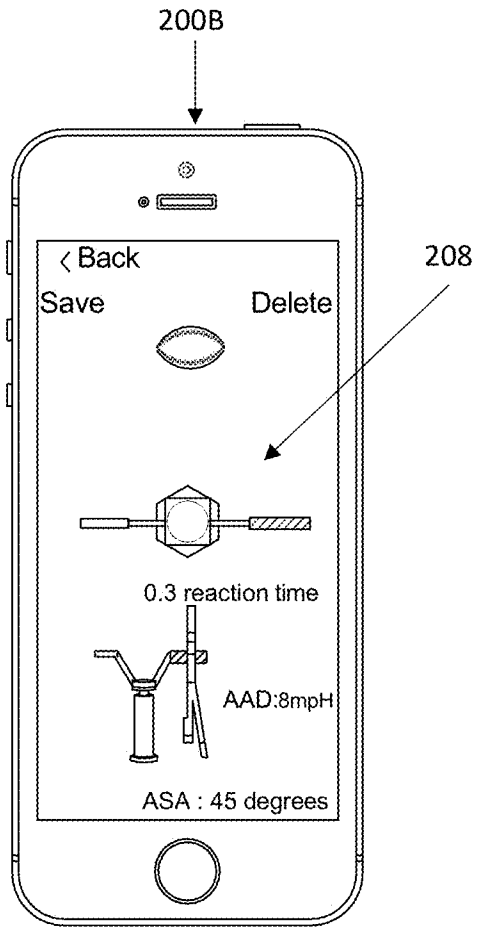
FIGS. 4A, 4B, 4C and 4D schematically illustrate a graphical user interface, showing various output reporting of an athlete's performance in the drill of the disclosed technology with respect to an agility post, according to one or more embodiments shown and described herein.
Figure 4B:
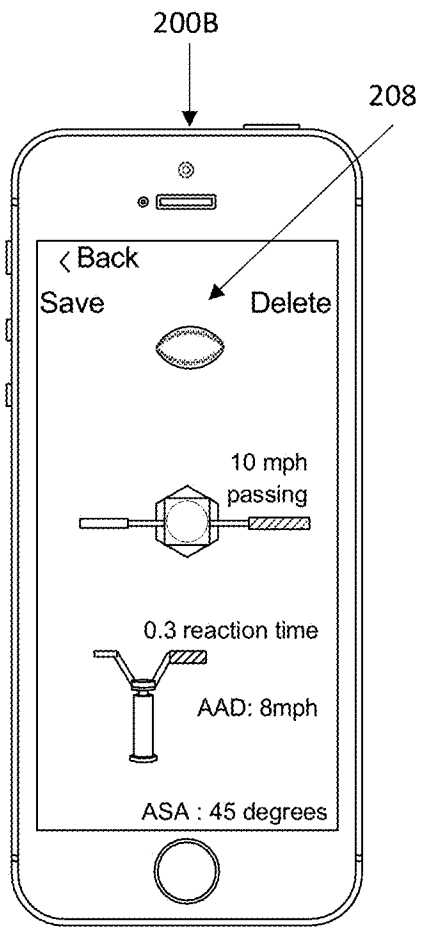
Figure 4A:
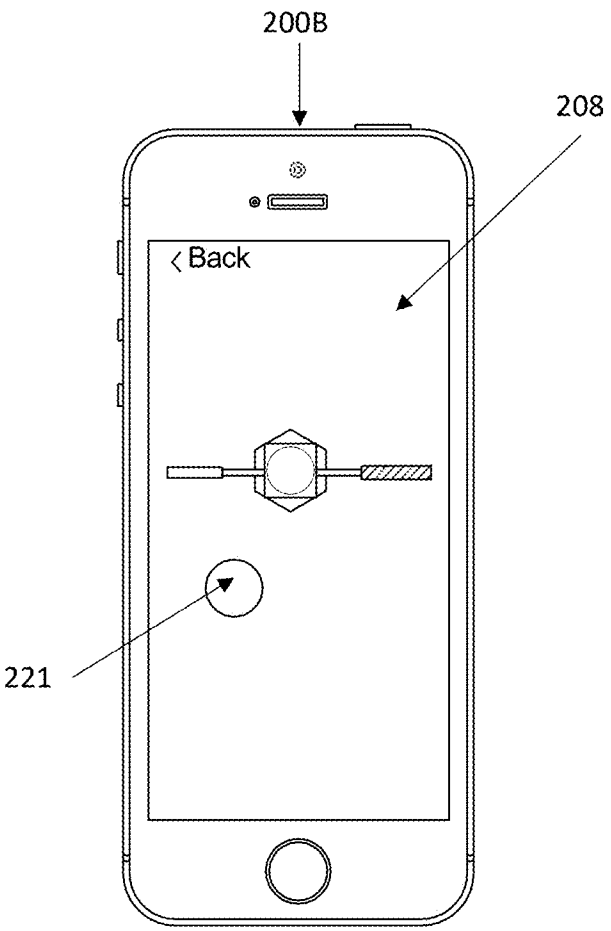

As shown in FIGS. 4A, 4B, 4C, 4D and 5, the computing device 900 (or the communications module) may calculate (from the programmed light sequence path, the sensor data and/or the camera data) and report at 231 information regarding an athlete's performance on the drill to the interface 208. For example, movement of an athlete about the agility post based upon sensor data may be depicted by a circle or other indicator 221 (see FIGS. 4A and 4D). Further, on one or more screens, the speed, reaction time, average arm drive (AAD) speed, and average shin angle (ASA) of the athlete may be calculated and displayed on the interface, as shown in FIGS. 4B and 4C. The athlete's body position and primary joint and body lines may also be shown as the athlete moves through the drill (see FIG. 4D).

The speed (distance (d)/time (t), or velocity (v)) and acceleration ($\Delta v/\Delta t$) of an athlete may be calculated using sensor data, camera data, or programmed light sequence path data, or any combination thereof. For example, the aggregate sensor data provides the path of the athlete as he/she engages in the drill. Using this data and a clock (or time data associated with the sensor data), the computing device may calculate both speed and acceleration of the athlete for the entire drill, or for any segment thereof, or real-time throughout the drill, and display the same on the user interface. Alternatively, camera data with sensor data, or alone, and/or with the light sequence data, accompanied with times associated with such data or an independent clock, may be used to calculate the speed of the athlete.

Reaction time is the time it takes for an athlete to respond to a stimulus (e.g., LED lights) after it is presented; stated differently, it measures how quickly the athlete perceives and processes information and then initiates a physical response. Combining sensor data (or camera data) with light sequence data, and any associated or independent clock data, the computing device may calculate and report on the interface the reaction time of the athlete. This may be calculated for example as the time differential between the time a light signal indicating that the athlete is to act is activated and the time of sensor data indicative of the athlete's corresponding action, and reported on the interface.

Driving one's arm while running generates an in-sync motion with an athlete's lower body, creating acceleration, body torque and balance. Therefore, it is useful to calculate the average AAD speed of the athlete as he or she practices the drill. Using video data from the camera, the AAD speed may be calculated, wherein the computing device 900 translates upwards and downwards movement of the dribbling arm 234 to data, and using the camera time can determine the amount of time it takes for the athlete to complete each upward and downward cycle (dribble). The dribble times throughout the drill may then be averaged by the computing device and reported on the interface.

Similarly, the athlete's average shin angle (ASA) 250 relative to the ground may be calculated by the computing device during performance of the drill. A forward ASA helps with propulsion and promotes efficient transfer of energy from the lower limbs to the ground. It also can facilitate the use of gravity to aid momentum and reduce the risk of excessive braking forces. Importantly, the shin angle should be neutral and balanced, and not exaggerated; an overly aggressive forward lean can lead to poor running mechanics, loss of stability and increased risk of injury. Calculating the shin angle as an athlete travels through the drill can be extracted from the camera data (using the primary joint and body lines generated therefrom), averaged, and reported on the interface.

Additional data including the athlete's distance from the post as he or she passes under the post arms, for example, by may be calculated using side sensor data and/or cameras, and reported on the user interface.

Figure 4D:
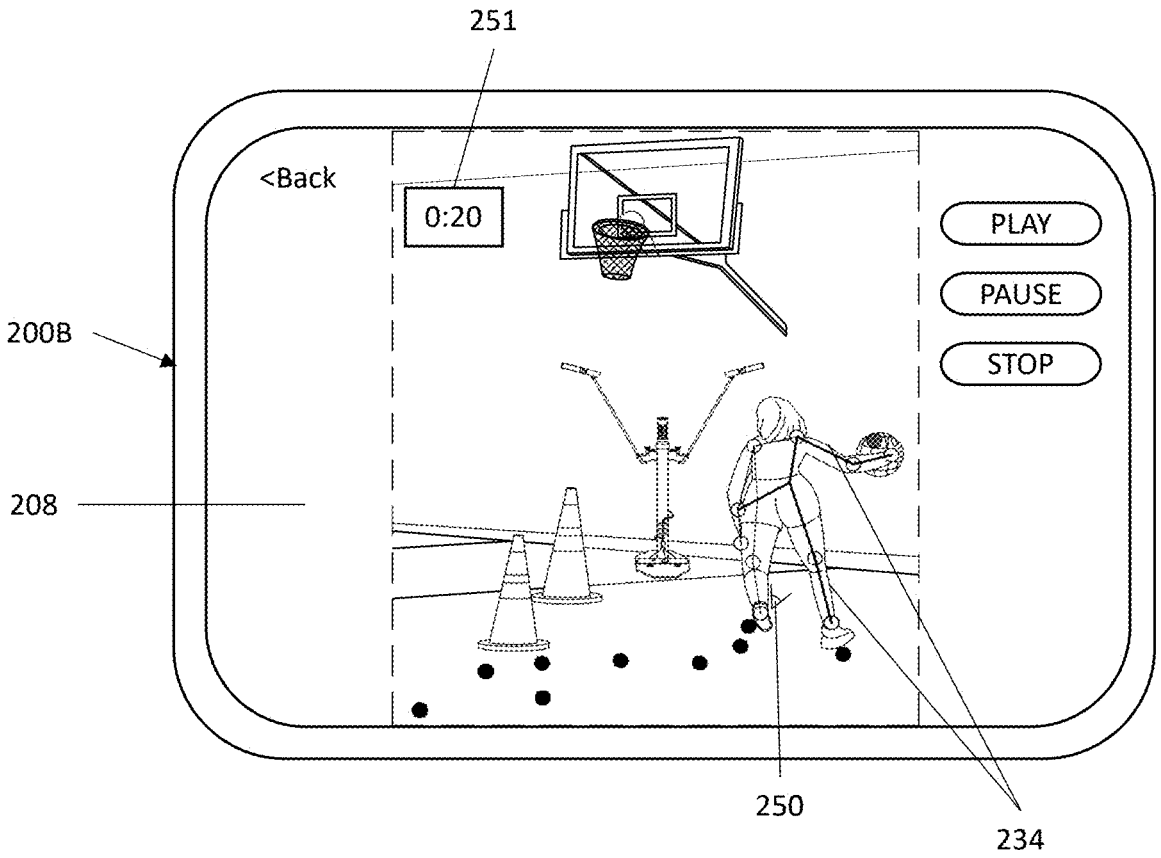

In embodiments, video (or characterized video, or a two-dimensional symbol, such as a circle) of the athlete and his/her movement through the drill may be shown on the interface (see, e.g., FIGS. 4C and 4D). As shown in FIG. 4D, the video may include primary joint and body lines 234 for teaching purposes. Upon completion of a drill, the same may be saved for later use or comparison for purposes of improvement, or deleted.

In embodiments, a user can access through the interface a plurality of preset light directional sequences, modify at least one of the plurality of preset light directional sequences, or create a new light directional sequence. In some embodiments, users can save and upload their performance data as well as load the performance data of other users. For example, a user may want to compare their abilities to a famous professional athlete. If directional sequence data is available for that athlete, it can be loaded through the interface and provided to the agility post, which may then provide the loaded directional sequence as a light path sequence for the user to compete against.

In some embodiments, time data for each segment of the light path sequence may be pre-programmed either by the computing device or customizable via the user interface; in addition or alternatively, the light path sequence or segments thereof may be conditioned upon sensor data, In various embodiments, one or more customizable delay values may be provided to add a time buffer to one or more segments and/or lights in the light path sequence. A delay value may be uniform with respect to each light in the light path sequence, or each light and/or each segment may have its own delay value. A finish option may allow a user to terminate the sequence.

A time indicator 251 may be displayed to represent a current elapsed time. In other embodiments, this may be provided as a playback timer when showing a past user's path through the light sequence drill. In other embodiments, the time indicator 251 may provide a total amount of time that completing the stored drill sequence took. In some embodiments, a ranking of top times or other data, or combination of data, for a given directional sequence may be utilized. For example, if a user uploads their performance data for a given drill sequence, their performance can be compared against how other users did for the same drill sequence. A social media website may post the times or other performance data, or combinations thereof, of various users for a given directional sequence, such as in a continuously updated top ten users, and may make the directional sequence of other users available for download.

Figure 6:
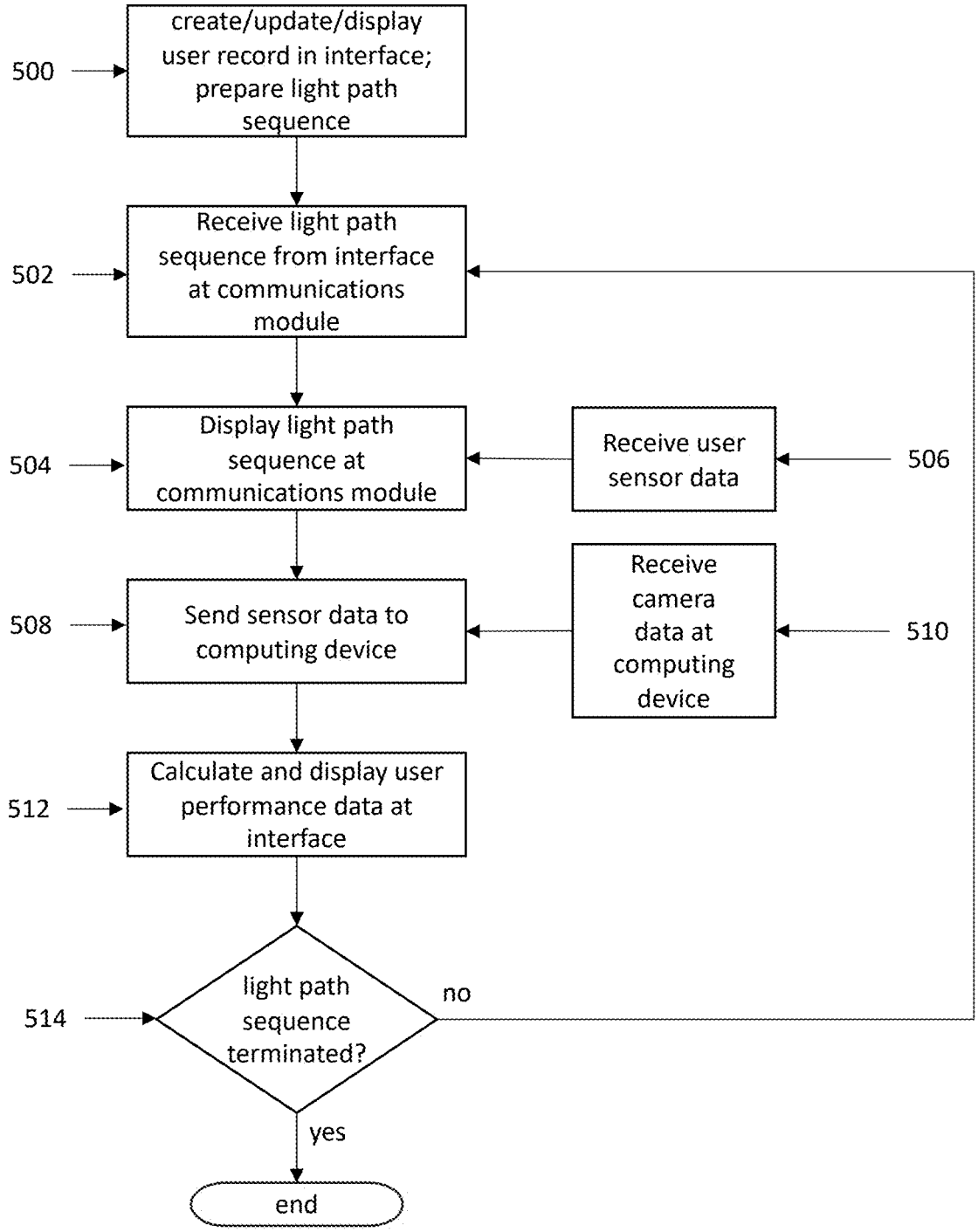
FIG. 6 is a flow chart depicting the interaction of sensors, agility post, and computing device and its interface, according to one or more embodiments shown and described herein.

Turning now to FIG. 6, a flowchart of the exemplary interaction of sensors, cameras, agility post(s), and interface is shown according to various embodiments. At block 500, one or more user records are created, updated, and/or displayed at the graphical user interface 208, on the computing device, and a light path sequence is prepared. User records may be stored and/or accessed locally on the computing device running the interface or remotely (such as in a database, which may be remote, as discussed herein). At block 502, the computing device transmits light path sequence data to the communications module of the agility post(s). At block 504, the agility post displays the light path sequence according to the light path sequence data received from the interface. In this embodiment, the light path sequence may also be based upon data received from the sensors by the interface at block 506, and may be modified or triggered as sensor data is received corresponding to detection of the user by the sensor(s). For example, the stop light may hold for a period of time once the front sensor senses the athlete a distance away from the post, and then commence the subsequent lights of the light path sequence. At block 508, user sensor data may be sent to the computing device by the communications module, and at block 510 camera data may be sent to the computing device. At block 512 the computing device then calculates and displays user performance data on the interface. A determination may then be made at block 514 as to whether a light path sequence has terminated. In some embodiments the determination may be made based upon the location of the athlete, as determined by the sensors and/or the camera, relative to the agility posts. For example, once the computing device determines from sensor and/or camera data that the user successfully passed two posts in a sequence, then the sequence may be deemed to have terminated. In another example, if a user passes a post in the wrong direction (as determined by the computing device from sensor or camera data), then the interface may determine that the user has been disqualified for not following the directional sequence. If the light path sequence has not terminated, then the flowchart returns to block 502 to continue displaying the light path sequence at the next post. Otherwise, if the light path sequence has terminated, then in this embodiment the flowchart ends.

Figure 7:
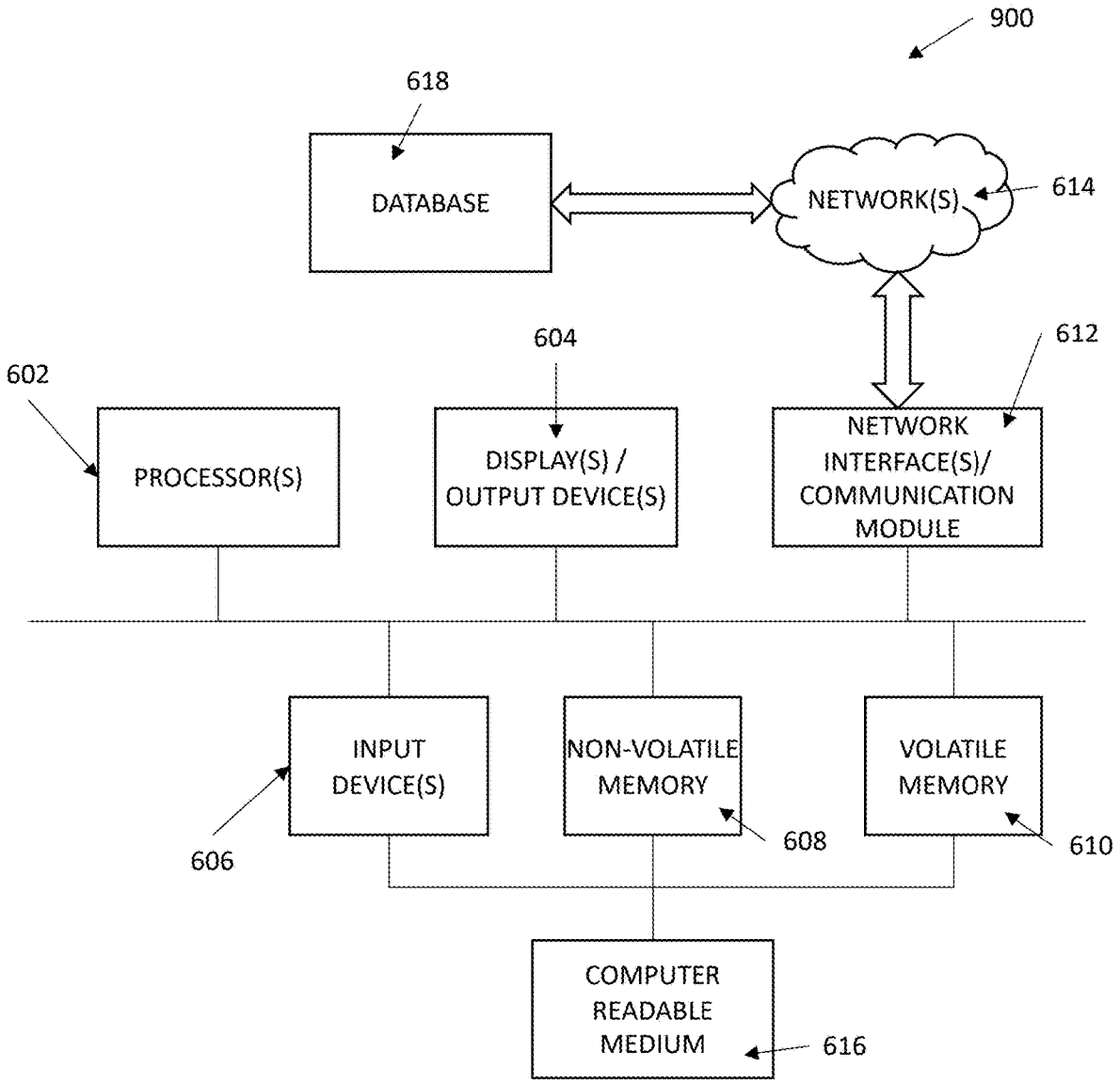
FIG. 7 is a block diagram illustrating computing hardware utilized in one or more agility posts, computing devices, and sensors, according one or more embodiments shown and described herein.

Turning now to FIG. 7, a block diagram illustrates an exemplary computing device 900, through which embodiments of the disclosure can be implemented. The computing device 900 described herein is but one example of a suitable computing device and does not suggest any limitation on the scope of any embodiments presented. The computing device 900 in some embodiments may also be utilized to implement an agility post, a sensor 600, a camera 700 and/or any combination thereof. Nothing illustrated or described with respect to the computing device 900 should be interpreted as being required or as creating any type of dependency with respect to any element or plurality of elements. In various embodiments, a computing device 900 may include, but need not be limited to, a desktop, laptop, server, client, tablet, smartphone, or any other type of device that can compress data. In an embodiment, the computing device 900 includes at least one processor 602 and memory (non-volatile memory 608 and/or volatile memory 610). The computing device 900 can include one or more displays and/or output devices 604 such as monitors, speakers, headphones, projectors, wearable-displays, holographic displays, and/or printers, for example. Output devices 604 may further include, for example, LED's and lasers 300, 310, 320 and 800 and/or audio speakers in an agility post, a screen and/or audio speakers, devices that emit energy (radio, microwave, infrared, visible light, ultraviolet, x-ray and gamma ray), electronic output devices (Wi-Fi, radar, laser, etc.), audio (of any frequency), etc.

The computing device 900 may further include one or more input devices 606 which can include, by way of example, any type of mouse, keyboard, disk/media drive, memory stick/thumb-drive, memory card, pen, touch-input device, biometric scanner, voice/auditory input device, motion-detector, camera, scale, and the like. Input devices 606 may further include sensors 600, sensing components of a computing device (touch screen, buttons, accelerometer, light sensor, etc.), and any device capable of measuring data such as motion data (accelerometer, GPS, magnetometer, gyroscope, etc.), biometric (blood pressure, pulse, heart rate, perspiration, temperature, voice, facial-recognition, iris or other types of eye recognition, hand geometry, fingerprint, DNA, dental records, weight, or any other suitable type of biometric data, etc.), video/still images, and audio (including human-audible and human-inaudible ultrasonic sound waves). Input devices 606 may further include cameras 700 (with or without audio recording), such as digital and/or analog cameras, still cameras, video cameras, thermal imaging cameras, infrared cameras, cameras with a charge-couple display, night-vision cameras, three-dimensional cameras, webcams, audio recorders, and the like.

The computing device 900 typically includes non-volatile memory 608 (ROM, flash memory, etc.), volatile memory 610 (RAM, etc.), or a combination thereof. A network interface 612 can facilitate communications over a network 614 via wires, via a wide area network, via a local area network, via a personal area network, via a cellular network, via a satellite network, etc. Suitable local area networks may include wired Ethernet and/or wireless technologies such as, for example, wireless fidelity (Wi-Fi). Suitable personal area networks may include wireless technologies such as, for example, IrDA, Bluetooth, Bluetooth or internet mesh networks, Wireless USB, Z-Wave, ZigBee, and/or other near field communication protocols. Suitable personal area networks may similarly include wired computer buses such as, for example, USB and FireWire. Suitable cellular networks include, but are not limited to, technologies such as LTE, WiMAX, UMTS, CDMA, and GSM. Network interface 612 can be communicatively coupled to any device capable of transmitting and/or receiving data via one or more network (s) 614. Accordingly, the network interface hardware 612 can include a communication transceiver for sending and/or receiving any wired or wireless communication. For example, the network interface hardware 612 may include an antenna, a modem, LAN port, Wi-Fi card, WiMax card, mobile communications hardware, near-field communication hardware, satellite communication hardware and/or any wired or wireless hardware for communicating with other networks and/or devices. One or more databases 618 may be accessed via the network(s) to remotely access data and store data, such as performance data relating to the user's performance on the agility post 100 via the interface 208 and data obtained from the sensors 600 and cameras 700.

A computer-readable medium 616 may comprise a plurality of computer readable mediums, each of which may be either a computer readable storage medium or a computer readable signal medium. A computer readable storage medium may reside, for example, within an input device 90006, non-volatile memory 608, volatile memory 610, or any combination thereof. A computer readable storage medium can include tangible media that is able to store instructions associated with, or used by, a device or system. A computer readable storage medium includes, by way of example: RAM, ROM, cache, fiber optics, EPROM/Flash memory, CD/DVD/BD-ROM, hard disk drives, solid-state storage, optical or magnetic storage devices, diskettes, electrical connections having a wire, or any combination thereof. A computer readable storage medium may also include, for example, a system or device that is of a magnetic, optical, semiconductor, or electronic type. Computer readable storage media and computer readable signal media are mutually exclusive.

A computer readable signal medium can include any type of computer readable medium that is not a computer readable storage medium and may include, for example, propagated signals taking any number of forms such as optical, electromagnetic, or a combination thereof. A computer readable signal medium may include propagated data signals containing computer readable code, for example, within a carrier wave. Computer readable storage media and computer readable signal media are mutually exclusive.

The computing device 900 may include one or more network interfaces 612 to facilitate communication with one or more remote devices, which may include, for example, client and/or server devices. A network interface 612 may also be described as a communications module, as these terms may be used interchangeably.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

It is noted that the terms "substantially" and "about" and "approximately" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Further, features described with one or more embodiments may be incorporated into other embodiments, and are not exclusive. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A non-transitory computer readable medium comprising instructions that, when executed by a processor, cause a software application to:

a. receive user positional data generated by a plurality of sensors positioned on an agility post, and communicated by means of a communications module positioned on the agility post, wherein the agility post includes a stanchion supported on a stability base and having two arms extending from and rotatably affixed to the stanchion, each arm presenting in segments, wherein at least one of the segments of each arm is rotationally coupled to another segment of the same arm;

b. receive video data from a plurality of cameras positioned on the agility post;

c. create and display a record associated with the user based upon the user positional data and the camera video data; and d. output to the communications module light sequence data, wherein the communications module activates a plurality of lights on the agility post in accordance with the light sequence data, wherein the plurality of lights include a top light positioned at the top of the stanchion, a second light positioned on the front of the stanchion, one or more lights positioned on or along each arm of the stanchion, and lasers positioned along the stability base.

2. The non-transitory computer readable medium of claim 1, further comprising instructions received to access a plurality of preset light sequences.

3. The non-transitory computer readable medium of claim 2, further comprising instructions received to modify at least one of the plurality of preset light sequences or to create a new light sequence.

4. The non-transitory computer readable medium of claim 1 further comprising instructions to receive input through the software application to modify the light sequence.

5. The non-transitory computer readable medium of claim 1, further comprising instructions to display within an interface a user's travel path, body position, speed and acceleration.

6. An interactive agility post system useful in training athletes comprising:

a. an agility post including a stanchion supported on a stability base and having two arms extending from and rotatably affixed to the stanchion, with a top light positioned at the top of the stanchion, a second light positioned on the front of the stanchion, one or more lights positioned on or along each arm of the stanchion, and lasers positioned along the stability base, and wherein the agility post supports a plurality of sensors and cameras;

b. a communications module secured to the agility post and configured to receive positional data from the sensors, to direct operation of the top light, the second light, the lights positioned on or along each arm, and the lasers pursuant to a light sequence, and to transmit the sensor data to a computing device; and c. wherein the computing device receives video data from the cameras and positional data from the communications module and calculates a user's travel path, body position, speed and acceleration, and displays the same on a user interface.

7. The interactive agility post system of claim 6, wherein the user interface of the computing device receives user input to create the light sequence, and wherein the computing device transmits the light sequence so created to the communications module.

8. The interactive agility post system of claim 6, wherein the arms present in segments, wherein at least one of the segments of each arm is rotationally coupled to another segment of the same arm.

9. A method comprising:

a. receiving from a plurality of sensors positional data of a user relative to an agility post, the agility post including a stanchion supported on a stability base and having two arms extending from and rotatably affixed to the stanchion;

b. receiving from a plurality of cameras video data of the user relative to the agility post;

c. creating and displaying a record associated with the user based upon the sensor positional data and the camera data; and d. outputting to a plurality of lights on the agility post light sequence data configured to activate a light sequence in the plurality of lights, wherein the plurality of lights include a top light positioned at the top of the stanchion, a second light positioned on the front of the stanchion, one or more lights positioned on or along each arm of the stanchion, and lasers positioned along the stability base.

10. The method of claim 9, further comprising creating the light sequence data.

11. The method of claim 9, wherein the light sequence data is randomly generated by a computing device, and wherein a timing delay of the light sequence data is modified.

12. The method of claim 9, wherein the user record displayed comprises a user's travel path, body position, speed and acceleration.

13. The method of claim 9, wherein each arm of the agility post presents in segments, wherein at least one of the segments of each arm is rotationally coupled to another segment of the same arm.

* * * * *